US006278125B1

(12) United States Patent
Belek

(10) Patent No.: US 6,278,125 B1
(45) Date of Patent: Aug. 21, 2001

(54) SHIELDED RADIATION ASSEMBLY

(75) Inventor: Ronald E. Belek, Quaker Hill, CT (US)

(73) Assignee: Loctite Corporation, Rocky Hill, CT (US)

( * ) Notice: Subject to any disclaimer, the term of this patent is extended or adjusted under 35 U.S.C. 154(b) by 0 days.

(21) Appl. No.: 09/197,229

(22) Filed: Nov. 23, 1998

(51) Int. Cl.[7] ..... G21F 3/02
(52) U.S. Cl. ..... 250/519.1; 250/515.1
(58) Field of Search ..... 250/515.1, 517.1, 250/519.1, 455.11; 378/203

(56) References Cited

U.S. PATENT DOCUMENTS

| | | | |
|---|---|---|---|
| 3,626,424 | 12/1971 | Kahn . | |
| 3,643,342 | 2/1972 | Tyson et al. . | |
| 3,811,044 | 5/1974 | Meador, Jr. . | |
| 3,960,081 | 6/1976 | Gustavs et al. . | |
| 3,967,129 | 6/1976 | Winkler . | |
| 3,984,696 | * 10/1976 | Collica et al. | 250/519.1 |
| 4,005,135 | 1/1977 | Helding . | |
| 4,048,537 | 9/1977 | Blaisdell et al. . | |
| 4,062,518 | * 12/1977 | Stivender et al. | 250/519.1 |
| 4,391,663 | 7/1983 | Hutter, III . | |
| 4,471,226 | 9/1984 | Wisnosky et al. . | |
| 4,477,326 | 10/1984 | Lin . | |
| 4,555,626 | 11/1985 | Suzuki . | |
| 4,581,538 | 4/1986 | Lenhart . | |
| 4,584,480 | 4/1986 | Silverman et al. . | |
| 4,623,795 | 11/1986 | Knopp et al. . | |
| 4,638,166 | 1/1987 | Baudro . | |
| 4,675,346 | 6/1987 | Lin et al. . | |
| 4,694,180 | 9/1987 | Salisbury et al. . | |
| 4,924,599 | 5/1990 | Bubley . | |
| 4,965,456 | 10/1990 | Huettenrauch et al. . | |
| 4,968,871 | 11/1990 | Hamrin . | |
| 5,013,924 | 5/1991 | Armstrong et al. . | |
| 5,026,741 | 6/1991 | Arai et al. . | |
| 5,179,134 | 1/1993 | Chu et al. . | |
| 5,204,534 | 4/1993 | Dubuit . | |
| 5,288,526 | 2/1994 | Hogan et al. . | |
| 5,595,118 | 1/1997 | Villaverde, Sr. et al. . | |
| 5,667,850 | 9/1997 | Gaven et al. . | |

* cited by examiner

*Primary Examiner*—Bruce C. Anderson
(74) *Attorney, Agent, or Firm*—Hoffmann & Baron, LLP

(57) ABSTRACT

A shielded radiation assembly provides easy access to a radiation treatment space while minimizing radiation leakage. The shielded radiation assembly includes a support structure and a radiation shield supported on the support structure. A radiation emitting device is movably supported on the support structure for movement independent of the radiation shield. The radiation shield may be flexible, including a plurality of radiation shielding sections which are supported by the support structure. The radiation shielding section may be formed of the radiation absorbing material.

20 Claims, 6 Drawing Sheets

SHIELDED RADIATION ASSEMBLY

FIELD OF THE INVENTION

The present invention relates to a shielded radiation assembly for protecting operating personnel from the exposure to potentially harmful radiation. More specifically, the invention relates to a radiation shield for a radiation emitting device that allows easy access to the radiation treatment space while minimizing radiation leakage.

BACKGROUND OF THE INVENTION

The controlled radiation of plastics results in the cross-linking of polymer chains and, thereby, provides desirable characteristics to products made from the plastics. It is well known in the plastic films industry that radiation treatment strengthens a film. Various types of coatings are also treated with radiation to improve the bonding of the coating to the object that is being coated. In addition, various adhesive materials are exposed to radiation to promote the curing. This is especially important in production line manufacturing, where the fast curing of an adhesive is required so that the article being produced can be expeditiously moved to the next stage in the production sequence.

A particularly useful form of radiation treatment in manufacturing applications is ultraviolet (UV) curing. UV curing is an electrically based technology which uses ultraviolet radiation generated by a high voltage power supply to rapidly convert certain photo-reactive materials from liquids to solids. These ultraviolet-curable materials include, inks, coatings and adhesives. Although these materials are liquids in their uncured state, they contain no volatile organic compounds (VOCs) and, thus, avoid one of the more serious problems encountered when organic compounds (VOCs) and, thus, avoid one of the more serious problems encountered when using solvent-based adhesives, i.e., the safe venting and treatment of the VOCs before releasing them into the atmosphere.

Polymer-based adhesives are used extensively in many industries, such as the automotive industry, the medical industry, and the electronics industry, as the most efficient means of joining two or more elements. The inherent disadvantage of the use of adhesive is the time factor for setting or curing the adhesive. Air dried adhesives can take from several minutes to several hours to cure and, as a result, make it difficult to implement continuous manufacturing processes. In order to solve this problem, certain polymer-based adhesives have been developed, which cure at an accelerated rate when subjected to ultraviolet radiation. Ultraviolet radiation curing is a process which involves polymerization, or cross linking of monomers upon exposure of the monomer to ultraviolet radiation. For monomers that do not polymerize when exposed to ultraviolet radiation, a sensitizer is added which absorbs ultraviolet energy and initiates a polymerization reaction in the monomer. The use of ultraviolet radiation provides significant processing and handling advantages during manufacture by instantly immobilizing the resin. Immobilization of the resin is controlled to provide sufficient gelation to prevent flow out of the part but allow good wetting between layers, thus assuring even resin distribution, reduced void formation and ease of handling of the finished part without resin migration, sagging or dripping. In addition to a substantial saving of time, there is also a considerable saving in plant space, since an ultraviolet curing line is faster and considerably shorter than previous systems which utilized other means for accelerating the curing of adhesives, such as ovens. Another advantage of ultraviolet cured adhesives over solvent-based adhesives is that the radiation treatment does not discharge volatile organic compounds into the atmosphere.

While UV curing addresses certain industrial needs, there are safety concerns involved with the use of ultraviolet radiation curing systems. Serious bums to the skin and eyes can be caused by the high intensity of the ultraviolet radiation if adequate shielding in not provided. This problem is complicated by the fact that ultraviolet bums are not felt for several hours, so that serious injuries can occur without the person realizing that the injury is occurring. In addition, a considerable amount of infrared energy is produced by the ultraviolet emitting device which can be harmful to personnel and can damage the products which are treated by the ultraviolet radiation. Although prior art devices provide shields to protect individuals from ultraviolet radiation, these shields are not always effective because manufacturing requirements necessitate that the equipment be designed to allow easy and continuous access to the radiation zone. As a result, many of the shields do not always totally enclose the radiation zone and a certain amount of radiation escapes the system. In other cases, the shields are not adjustable and do not allow the equipment to be used for a variety of different applications.

SUMMARY OF THE INVENTION

The present invention provides a shielded radiation assembly that includes a support structure. The support structure supports a radiation shield. A radiation emitting device is moveably supported on the support structure for independent movement with respect to the radiation shield. The shield defines an enclosed space about the radiation emitting device for protecting against radiation leakage.

In preferred embodiments of the present invention, the support frame includes a base for supporting an object which is to be subjected to radiation. An upright support member extends from the base and supports both the shield and the radiation emitting device. The radiation emitting device is movable along the upright support member with respect to the base to vary its position with respect to the object. The shield may also be movable with respect to the base to raise and lower the shield to provide access to the enclosed space.

The support structure may also support one or more cooling fans. The fans may be positioned so as to dissipate heat generated by the radiation emitting device.

Preferred radiation emitting devices include radiation emitting devices that emit actinic radiation, including ultraviolet and visible light.

Preferred shields can be made from a variety of materials, including radiation absorbent materials, radiation reflective materials and metal coated materials.

BRIEF DESCRIPTION OF THE DRAWINGS

The radiation shield assembly of the present invention will become readily apparent after reading the following description of the accompanying drawings in which.

DETAILED DESCRIPTION OF THE PREFERRED EMBODIMENTS

Figure 1:
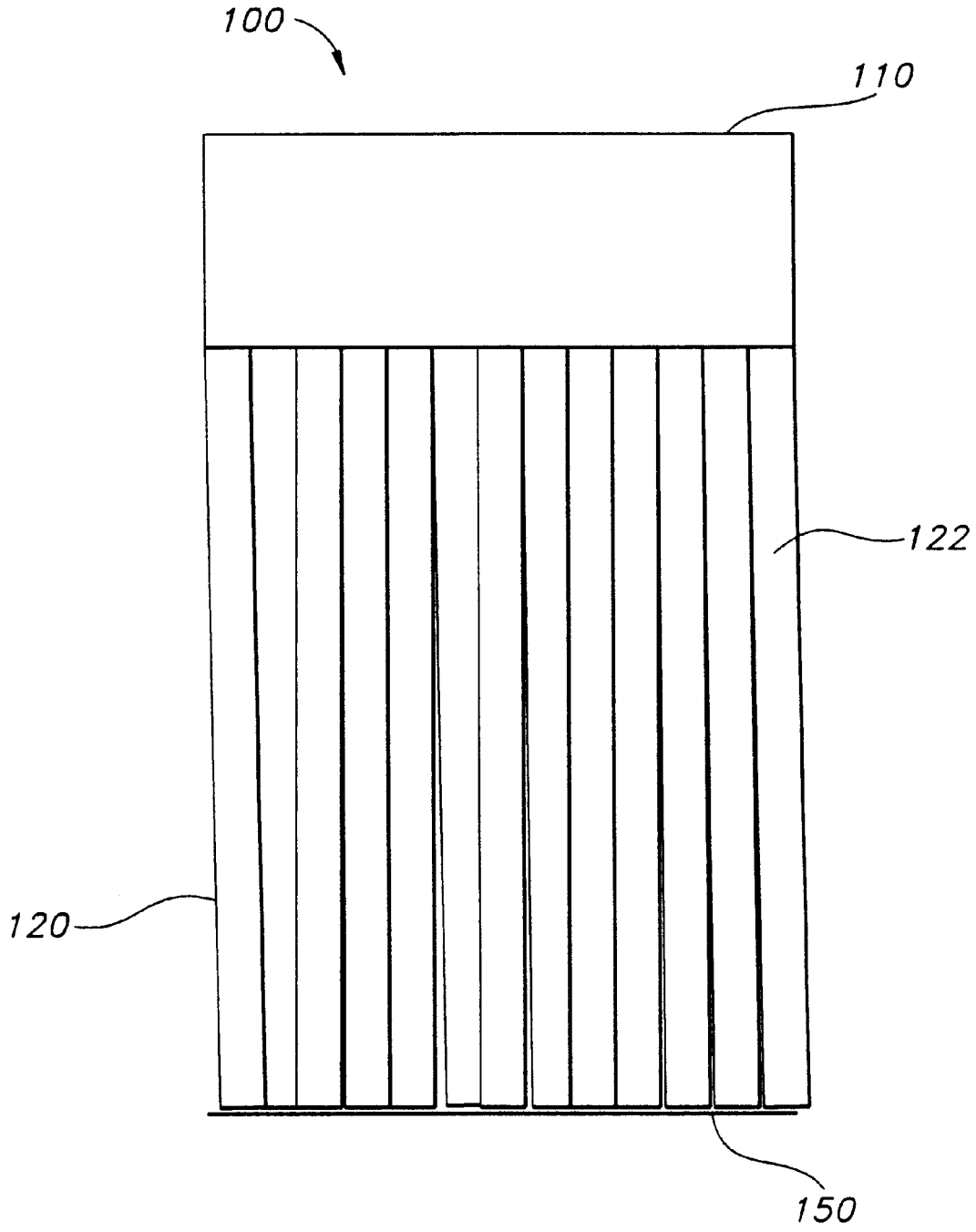
FIG. 1 is a front view of the shielded radiation assembly of the present invention.

The shielding assembly of the present invention protects a person from the harmful effects of radiation that is used to irradiate a radiation space, while permitting easy access to the space. The shielding assembly includes a radiation emitting device and a radiation shield that encloses the radiation space to prevent the leakage of radiation.

Referring to the drawings, a shielded radiation assembly 100 includes a radiation shield 120, a radiation emitting device 160 and a support structure 115. The support structure 115 supports radiation emitting device 160 and radiation shield 120. The area enclosed by the radiation shield 120 defines a radiation space 190.

Support structure 115 includes a generally planar base 150, an elongate upright support member 130 extending from the base 150, and a shield support frame 110. Shield support frame 110 is a rectangular frame-like member having four sides which define interiorly thereof radiated space 190. While a rectangular structure is shown in the drawings, support frame 110 may take any shape which forms a full or partial enclosure. The shield support frame 110 is attached to the upright support member 130 at one side 110*a* thereof by a frame fastening member 170 so as to overlie base 150. Preferably, the frame fastening member 170 is adjustable so that the shield support frame 110 can be moved to allow access to the base for maintenance or to position an object within the radiation space 190.

Figure 2:
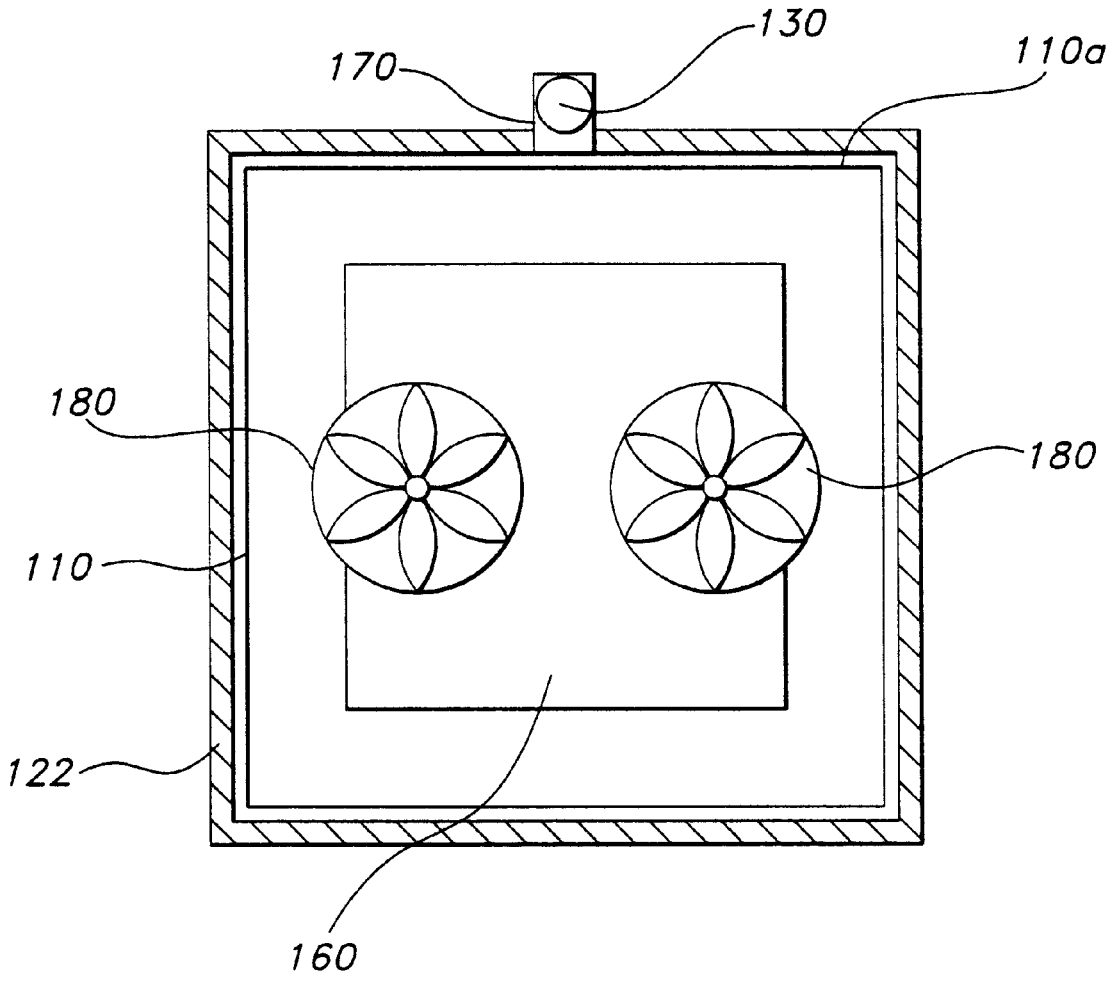
FIG. 2 is a top view of the shielded radiation assembly of FIG. 1, showing the cooling fans and shield support frame.

Radiation shield 120 is preferably a curtain formed by a plurality of elongate, slat-like radiation shielding sections 122 that are vertically suspended from a support frame 110 in side-by-side fashion. FIG. 2 shows a top view of the shielded radiation assembly 100 with shielding sections 122 extending downwardly from the sides of support frame 110 so as to perimeterically enclose the radiated space. Each shielding section 122 is at least partially overlapped by another section 122. The shield sections 122 allow the radiation shield 120 to be manually penetrated at any point between adjacent shield sections 122 and thus provide easy access to the radiation space 190 for positioning and removing articles. The shield sections 122 of the radiation shield 120 allow the shield 120 to conform to the contour of the radiation space 190 and provide a substantially continuous enclosed shield that prevents the leakage of radiation from the radiation space 190. The radiation shield sections 122 can be either rigid or flexible and can be made from several different types of materials, including radiation absorbent materials, radiation reflective materials, metal coated materials, and coated thermoplastic materials. Where the sections 122 contain lead, the lead can be in the form of a layer or the sections 122 can be made of a material impregnated with lead. Other methods for forming radiation shields known in the art can also be used.

The radiation shield 120 can be used in combination with various radiation emitting devices, including ultraviolet. In the preferred embodiment, the radiation shield 120 is used with radiation emitting devices that emit actinic radiation. As used herein, "actinic radiation" means radiation that is capable of producing chemical change. When actinic radiation is used to cure resin based adhesive materials, the term refers to electromagnetic radiation having a wavelength of about 700 nm or less which is capable, directly or indirectly, of curing the specified resin component of the resin composition. By indirect curing in this context is meant curing under such electromagnetic radiation conditions, as initiated, promoted, or otherwise mediated by another compound. Actinic radiation includes ultraviolet and visible light.

The most common criteria for selecting shielding materials are radiation attenuation, ease of heat removal, resistance to radiation damage, economy and structural strength. Based on the type of radiating emitting device that is used, the intensity of the radiation and the particular application, the selection of the radiation shield can vary. The overall thickness of the material is chosen to reduce radiation intensities outside the shield to levels well within prescribed limits for occupational exposure. The shield 120 can be fabricated from a variety of materials including radiation absorbent materials, radiation reflective materials, metal coated materials and coated thermoplastic materials. In a preferred embodiment, the shield 120 is made of a transparent acrylic copolymer resin.

The radiation emitting device 160 is also attached to the support structure 115. Radiation emitting device 160 is adjustably supported to upright support member 130 by a device fastening member 140. The position of the radiation emitting device 160 can be adjusted vertically with respect to base 150 so that it can be moved closer to or further away from the object (not shown in figures) that is being radiated. The adjustable device fastening member 140 also allows the radiation emitting device 160 to rotate around the support structure 115 so that it can be more accessible for service and repair. The radiation emitting device 160 can be adjustably positioned at any point along the upright support member 130, according to how the shielded radiation assembly 100 is to be used. When an object is radiated, the radiation emitting device 160 can be lowered to provide a more intense radiation dosage. It also can be raised to provide a less intense radiation dosage or to accommodate larger objects.

Figure 3:
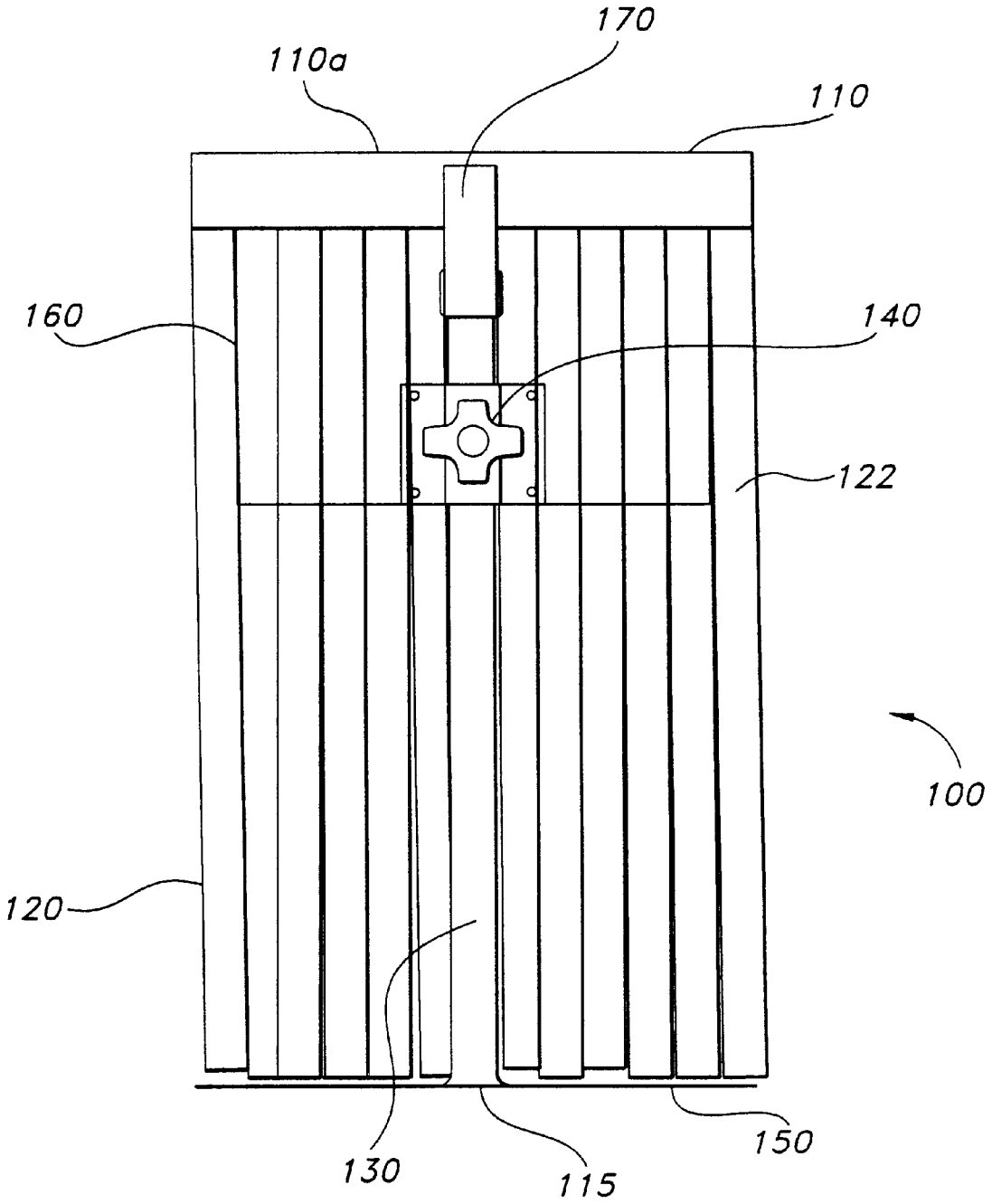
FIG. 3 is a rear view of the shielded radiation assembly of FIG. 1, showing the radiation emitting device in a raised position.
Figure 4:
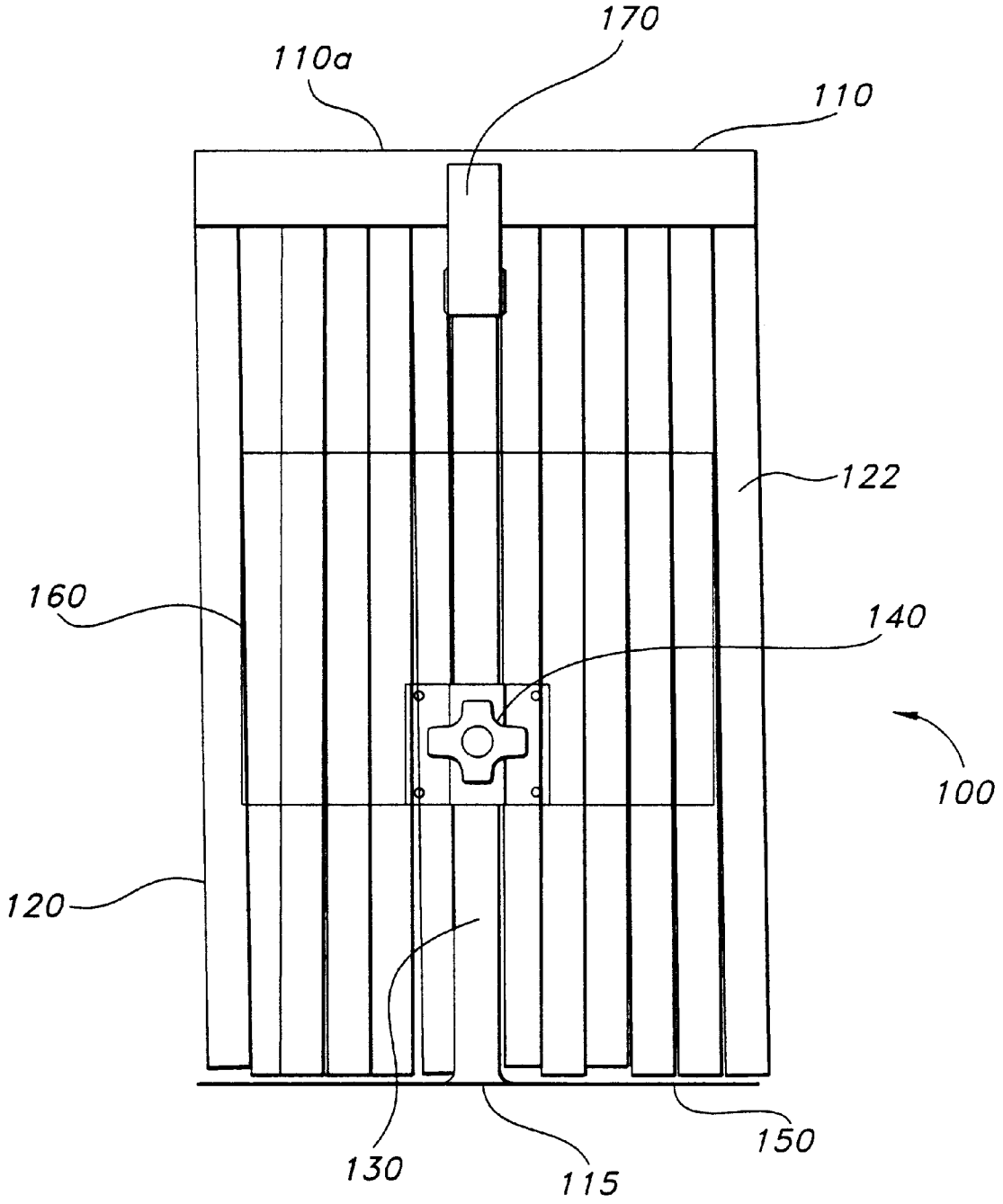
FIG. 4 is a rear view of the shielded radiation assembly of FIG. 1, showing the radiation emitting device in an intermediate position.
Figure 5:
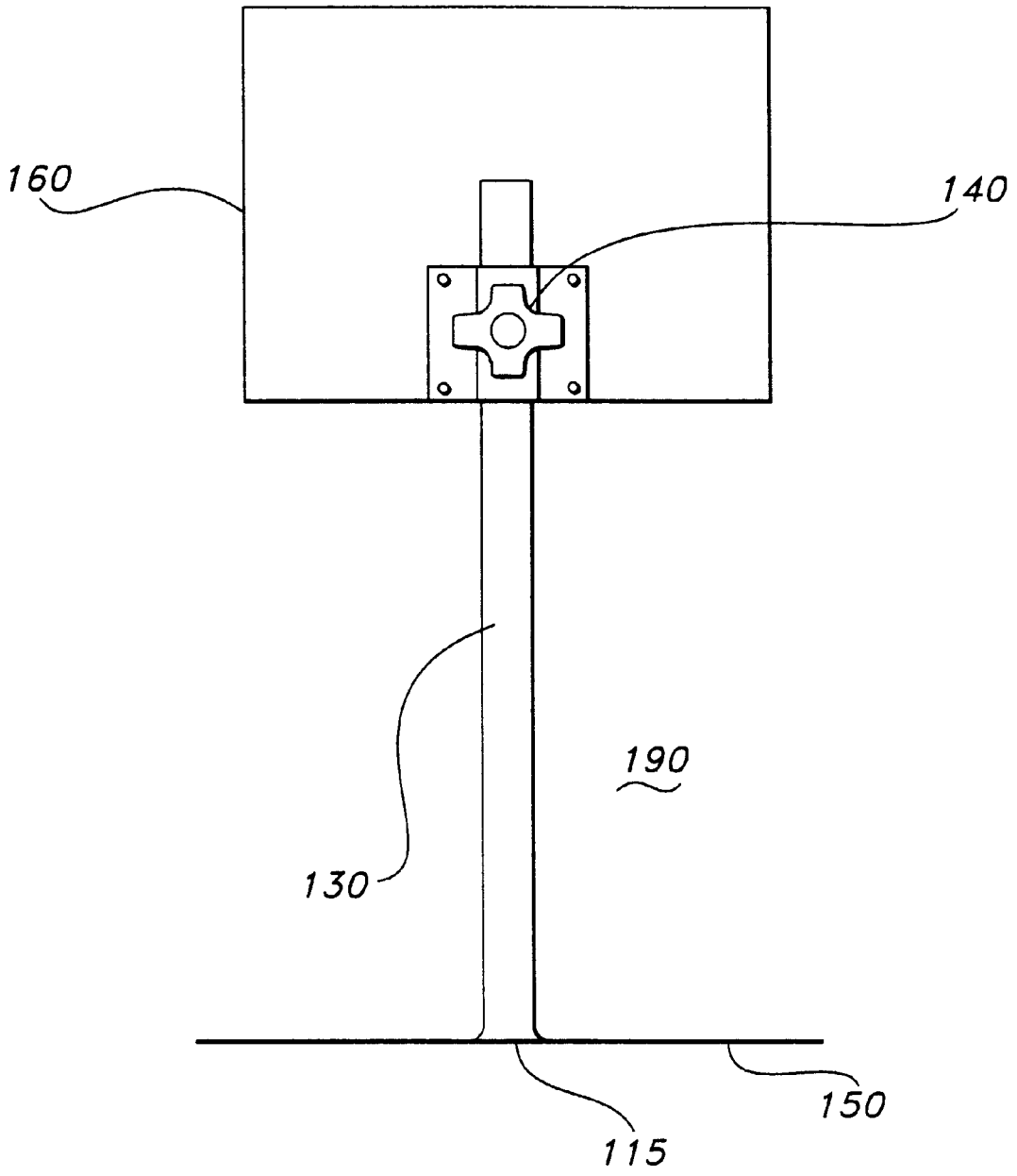
FIG. 5 is a rear view of the shielded radiation assembly of FIG. 1, showing the radiation emitting device with the shield removed.

As illustrated in FIGS. 3 and 4, the radiation emitting device 160 can be positioned independently so that the position of the radiation emitting device 160 can be adjusted without having to readjust the position of the shield 120. Prior art devices, which use a curtain made up of a plurality of vertical sections to form the radiation shield, attach the curtain to the radiation emitting device 160. When the radiation emitting device 160 is lowered, the curtain bends and openings are formed between the vertical sections. These openings allow radiation to leak out of the enclosed space. The present invention overcomes this problem by maintaining the radiation shield 120 in position while the radiation emitting device 160 is either lowered or raised. Thus, the vertical sections 122 of the curtain do not fold open and the integrity of the shield is continuously maintained.

Figure 6:
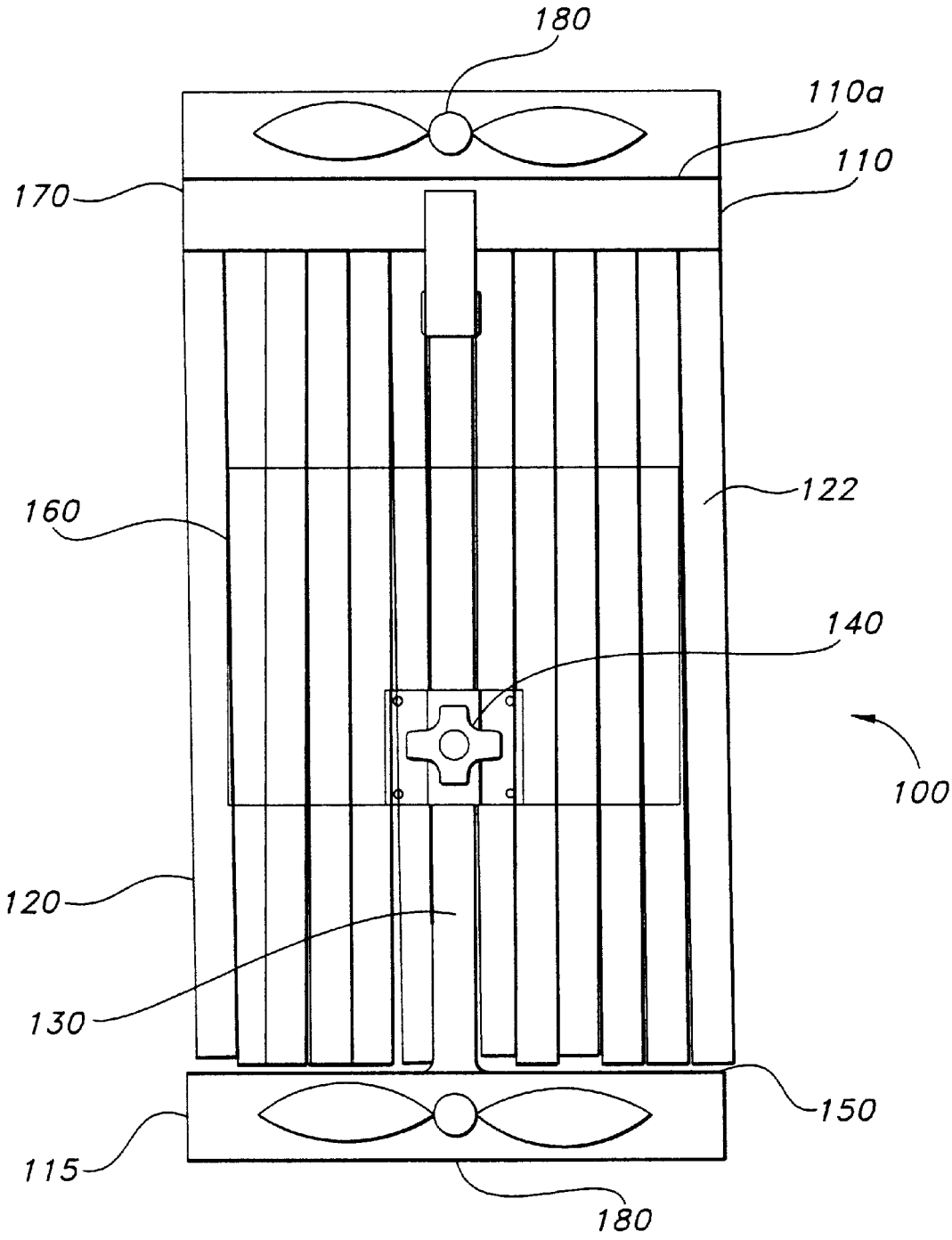
FIG. 6 is a rear view of the shielded radiation assembly of FIG. 1, showing the cooling fans.

The shielded radiation assembly 100 may also include a fan, radiating fins, liquid cooling system or a combination thereof for dissipating heat generated by the radiation emitting device 160. One or more cooling fans 180, as shown in the drawings, is preferred for dissipating heat. As shown in FIG. 6, cooling fans 180 can be located both above the radiation emitting device 160 and below the work surface defined by base 150.

In a preferred embodiment, the radiation emitting device 160 is an ultraviolet lamp which can produce high temperatures. For example, a 300 watt/inch mercury vapor lamp that generates 800 $MW/cm^2$ ultraviolet energy in the 360 nanometer region can produce temperatures in excess of 480° F. in the radiation space. Over a prolonged period of time, these high temperatures can shorten the life of the lamp and can damage the radiation shield 120. Moreover, these high temperatures can damage the objects that are being irradiated. Many plastics and synthetic materials will begin to melt or deform at these temperatures. Therefore, in preferred embodiments that use an ultraviolet lamp, the shielded radiation assembly 100 includes the cooling fans 180 located above the radiation emitting device 160 and/or adjacent the base assembly 150 to provide convective cooling of the work space.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

What is claimed is:

1. A shielded radiation assembly comprising:

a support structure;

a radiation shield supported on said support structure; and a radiation emitting device moveably supported on said support structure for movement independent of said radiation shield;

wherein said shield defines a substantially enclosed space about said radiation emitting device for protecting against radiation leakage.

2. A shielded radiation assembly according to claim 1, wherein said shield is flexible.

3. A shielded radiation assembly according to claim 2, wherein said shield is a curtain.

4. A shielded radiation assembly according to claim 2, wherein said curtain includes a plurality of radiation shielding slats.

5. A shielded radiation assembly according to claim 1, wherein said shield is comprised of a material selected from the group consisting of radiation absorbent materials, radiation reflective materials, metal coated materials, coated thermoplastic materials and materials comprising lead.

6. A shielded radiation assembly according to claim 1, wherein said radiation emitting device emits actinic radiation selected from the group consisting of ultraviolet and visible light.

7. A shielded radiation assembly according to claim 1, wherein said support structure includes a base defining a support surface for accommodating an object to be radiated.

8. A shielded radiation assembly according to claim 7, wherein said support structure includes an upright support member extending from said base and a shield support frame for supporting said radiation shield.

9. A shielded radiation assembly according to claim 8, wherein said radiation emitting device is movably supported along said upright support member with respect to said base.

10. A shielded radiation assembly according to claim 9, wherein said frame is supported by said upright support member.

11. A shielded radiation assembly according to claim 10, wherein said frame is movably supported along said upright support member with respect to said base.

12. A shielded radiation assembly according to claim 10, further comprising an adjustable fastening member for movably supporting said radiation emitting device to said upright support member.

13. A shielded radiation assembly according to claim 12, wherein said support frame extends perimeterically about said radiation emitting device.

14. A shielded radiation assembly according to claim 9, wherein said frame is fixably supported by said upright support member.

15. A shielded radiation assembly according to claim 1, further including means for dissipating heat generated by said radiation emitting device.

16. A shielded radiation assembly according to claim 15, wherein said heat dissipating means includes at least one cooling fan supported by said support structure.

17. A shielded radiation assembly comprising:

a support structure;

an ultraviolet radiation emitting device moveably supported on said support structure; and a flexible radiation shield comprising a plurality of radiation shielding sections supported on said support structure for relative movement with said radiation emitting device;

wherein said shield defines an enclosed space about said ultraviolet radiation emitting device for protecting against radiation leakage.

18. A shielded radiation assembly according to claim 17, wherein said radiation shield is formed of a material selected from the group consisting of radiation absorbent materials, radiation reflective materials and metal coated materials.

19. A shielded radiation assembly according to claim 17, wherein said support structure comprises an upright support member extending from a base and a shield support frame for supporting said radiation shield.

20. A shielded radiation assembly according to claim 19, wherein said radiation emitting device is movably supported along said upright support member with respect to said base.

* * * * *

UNITED STATES PATENT AND TRADEMARK OFFICE

CERTIFICATE OF CORRECTION

PATENT NO. : 6,278,125 B1
DATED : August 21, 2001
INVENTOR(S) : Ronald E. Belek

It is certified that error appears in the above-identified patent and that said Letters Patent is hereby corrected as shown below:

Column 2,
Line 6, delete "Serious bums" and replace with -- Serious burns --.
Line 9, delete "ultraviolet bums" and replace with -- ultraviolet burns --.

Signed and Sealed this

Second Day of April, 2002

*Attest:*

*Attesting Officer*

JAMES E. ROGAN
*Director of the United States Patent and Trademark Office*